United States Patent [19]

Abbott

[11] 4,015,316

[45] Apr. 5, 1977

[54] COMBINATION TENSION AND SLUB CATCHING DEVICE

[75] Inventor: Samuel L. Abbott, Wilton, N.H.

[73] Assignee: Abbott Machine Co., Inc., Wilton, N.H.

[22] Filed: Oct. 1, 1975

[21] Appl. No.: 618,475

Related U.S. Application Data

[63] Continuation of Ser. No. 466,983, May 6, 1974, abandoned.

[52] U.S. Cl. ..... 28/64

[51] Int. Cl.[2] ..... D01H 13/22; B65H 63/06

[58] Field of Search ..... 28/64

[56] References Cited

UNITED STATES PATENTS

| | | | |
|---|---|---|---|
| 2,295,535 | 9/1942 | Abbott | 28/64 X |
| 3,501,820 | 3/1970 | Abbott | 28/64 |
| 3,543,357 | 12/1970 | Abbott | 28/64 |
| 3,704,495 | 12/1972 | Yamamoto | 28/64 |
| 3,769,668 | 11/1973 | Abbott | 28/64 |

*Primary Examiner*—Robert R. Mackey
*Attorney, Agent, or Firm*—Robert T. Gammons

[57] ABSTRACT

A combination tension and slub catching device wherein there are relatively fixed and movable members disposed in confronting relation to each other which define a narrow yarn passage, one of which is comprised of a plurality of narrow bars disposed transversely of the path of movement of the yarn and which are individually yieldable as an enlargement passes through the yarn passage and the other which is a rigid bar disposed longitudinally of the path of movement of the yarn, and wherein there is linkage which supports the rigid bar for movement rectilinearly relative to the narrow bars to vary the width of the yarn passage and a device responsive to changes in tension in the yarn connected to the linkage for adjusting the width of the yarn passage with changes in the tension of the yarn.

2 Claims, 12 Drawing Figures

COMBINATION TENSION AND SLUB CATCHING DEVICE

This is a continuation of application Ser. No. 466,983, filed on May 6, 1974, now abandoned.

BACKGROUND OF INVENTION

In my pending application Ser. No. 466,982, filed May 6, 1974 now U.S. Pat. No. 3,930,291, granted Jan. 6, 1976 there is shown a combination yarn tensioning and slub catching device wherein there are relatively fixed and movable members supported in confronting relation so as to define a narrow yarn passage, one of which is comprised of narrow individually yieldable bars disposed transversely of the path of movement of the yarn and the other of which is a rigid bar disposed longitudinally of the path of movement of the yarn. The rigid bar is pivotally mounted for angular movement relative to the narrow bars and there is a weighted lever which biases the rigid bar toward the narrow bars by means of which the tension in the yarn running through the passage may be varied. The device of this invention is concerned with another and different way of varying the tension in the yarn as it travels through the yarn passage.

SUMMARY OF INVENTION

A combination tension and slub catching device comprising relatively fixed and movable members supported in confronting relation so as to provide a narrow yarn passage wherein the member at one side of the yarn passage is yieldable to enlargements traveling through the passage and the member at the other side is movable relative to the one member to adjust the width of the yarn passage and tension responsive means for effecting rectilinear movement of said other member relative to the one member to vary the width of the passage inversely with changes in tension in the running yarn. The member of the one side embodies a surface which is progressively yieldable to enlargements passing through the yarn passage and the member at the other side embodies a surface which is rigidly unyielding. The one member is comprised of narrow parallel bars disposed and supported transversely with respect to the path of travel of the yarn through the yarn passage and the other is a rigid bar disposed longitudinally of the yarn passage. A linkage is employed to support the rigid bar for rectilinear movement toward the narrow bars and this linkage comprises spaced parallel links, means pivotally connecting the links at one end to fixed pivot pins, the axes of which are parallel to the face of the rigid bar, means pivotally connecting the same ends to the opposite ends of the rigid bar on axes spaced from and parallel the axes of the fixed pivot pins and means pivotally connecting the other ends of the links to the opposite ends of the rigid link corresponding substantially in length to the rigid bar. The sensing device is responsive to yarn tension and is connected to said linkage and there is means for adjusting the initial disposition of the linkage and hence the initial width of the yarn passage.

The invention will now be described in greater detail with reference to the accompanying drawings, wherein:

FIG. 1 is a front elevation of the preferred form of the invention;

FIG. 1A diagrammatically illustrates yarn detector mechanism;

Figure 1:
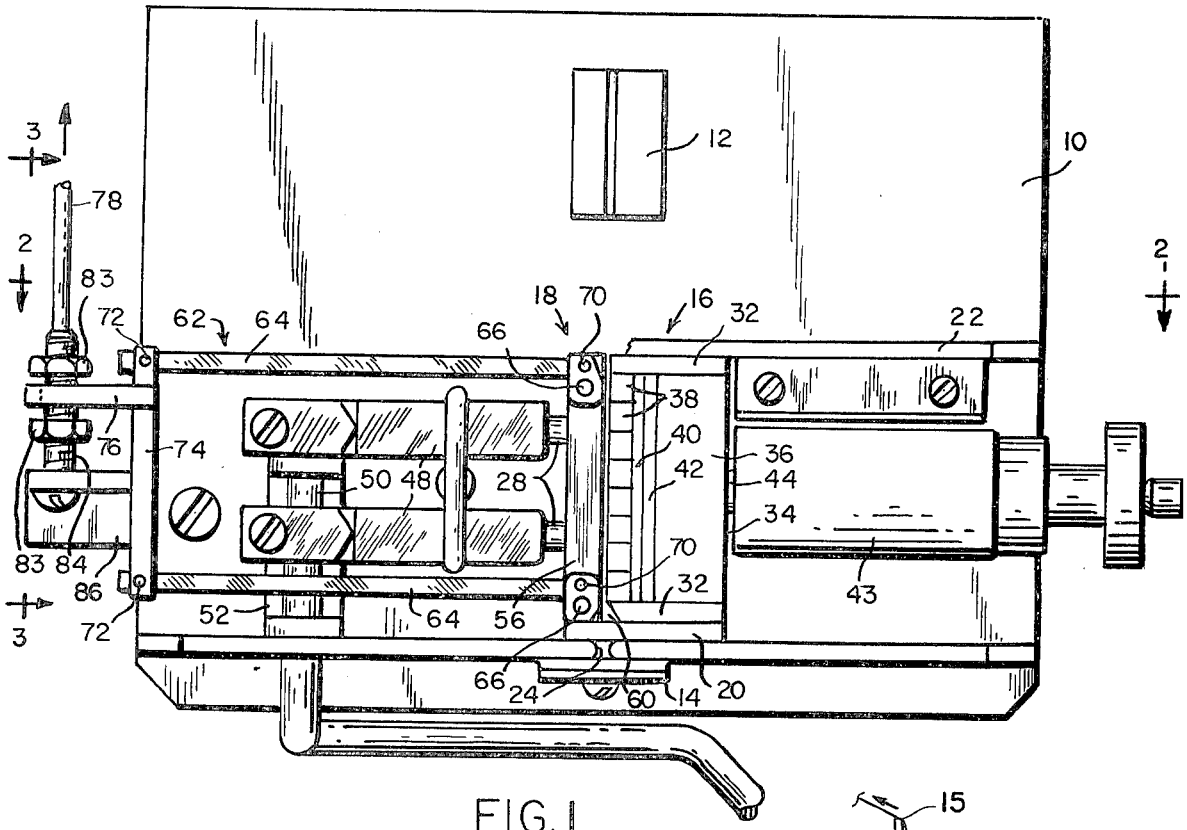

As herein illustrated the invention comprises a combination slub catching and tension device for use in processing yarn and may be used equally as well in conjunction with winding machines in which the winding units are stationary as shown in U.S. Pat. No. 2,277,574 or in which the winding units are traveling as shown in U.S. Pat. No. 2,266,726. In such machines, the yarn as it is unwound from a yarn mass and rewound to form a package of predetermined size or shape passes through tensioning and slub catching means such as shown in U.S. Pat. No. 2,623,265 wherein the slub catching and tensioning operations are carried out by separate independently operable devices. As herein illustrated the slub catching and tensioning operations are embodied in a single device which is supported on an apron 10, FIG. 1, between yarn guides 12 and 14 and comprises relatively fixed and movable assemblies 16 and 18 supported in confronting relation to each other at opposite sides of the path of yarn travel at their lower ends by a shelf member 20 secured to and extending forwardly from the apron and at their upper ends by a cover member 22 also secured to and projecting forwardly from the apron. Both the shelf and the cover contain, respectively, yarn passages 24 and 26 which are in alignment with the yarn guides 12 and 14. The fixed assembly 16 is fastened by suitable means to the apron between the shelf and the cover and the movable assembly 18 is slideable forwardly and rearwardly with respect to the fixed assembly while being yieldably held engaged therewith by spring pressed plungers 28—28 supported with their ends engaged with openings 30—30, FIG. 4, in the movable assembly as will be fully described hereinafter.

The fixed assembly 16 comprises vertically spaced parallel top and bottom members 32—32 and a back member 36. The plates 32—32 and 36 collectively comprise a blade holder which supports a plurality of narrow blades or bars 38 adjacent the path of travel of the yarn where the blades are disposed in transverse relation to the path of travel of the yarn, that is, with their long axes projecting forwardly from the face of the apron. The blades 38 are attached by means of adhesive to a yieldable pad 40 such as felt which in turn is attached to a rigid plate 42. The plate 42 is movable within the holder so that it is possible by moving the plate 42 to move the blades 38 in unison toward and away from the yarn path. The blades as thus supported are individually yieldable relative to the yarn path and movable in unison toward and away from the yarn path and there is means for adjusting the resistance of the entire array of blades and for adjusting the proximity of the array of blades relative to the yarn path comprising a spindle 44 yieldably supported in engagement with the rigid plate 42 within a barrel 43 which is threaded into the back plate to enable longitudinal adjustment of the spindle as shown in detail in U.S. Pat. No. 3,769,668. It is to be understood, however, that the blades 38 may be supported in the holder for adjustment relative to the yarn passage as shown in U.S. Pat. No. 3,543,357.

In the aforesaid U.S. Pat. No. 3,769,668, the blades 38 were employed to apply yarn tensioning and to vary the width of the yarn passage to effect removal of slubs. The blades in the apparatus herein shown or their equivalent are applied to soften the shock when a slub or other enlargement enters the yarn passage to avoid premature yarn breakage.

Figure 1A:
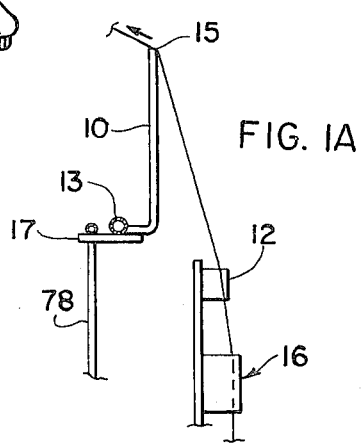
Figure 2:
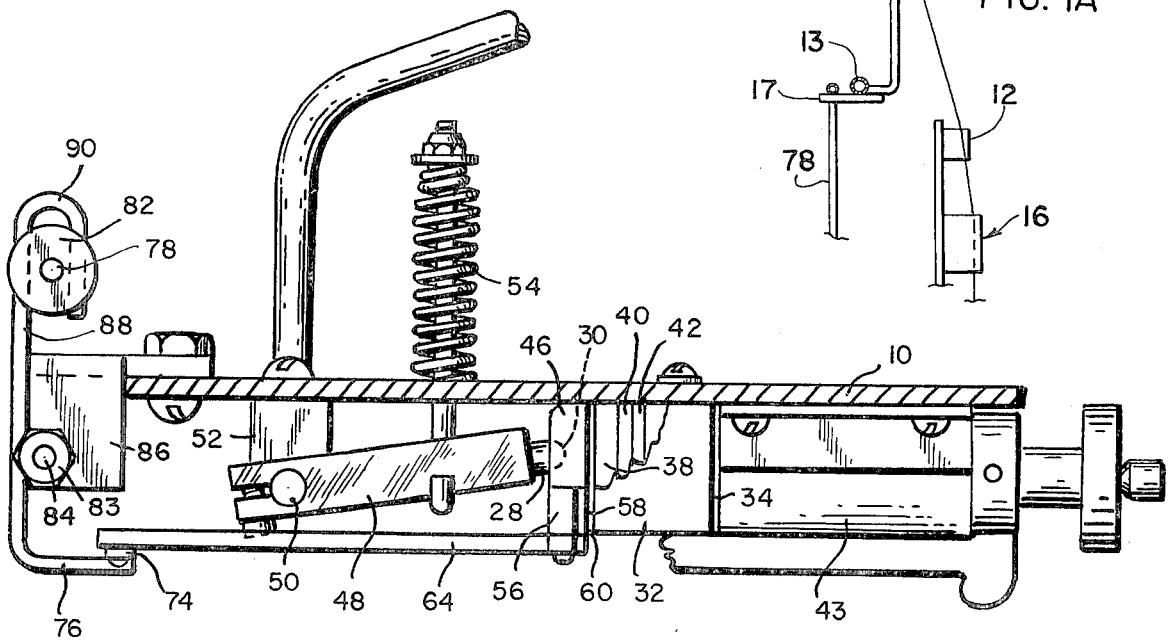
FIG. 2 is a top view taken in the line 2—2 of FIG. 1.
Figure 4:
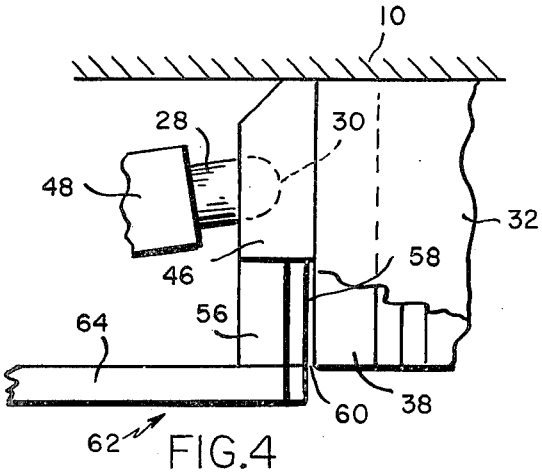
FIG. 4 is a fragmentary top view at the left side of FIG. 2 to larger scale with parts broken away.
Figure 3:
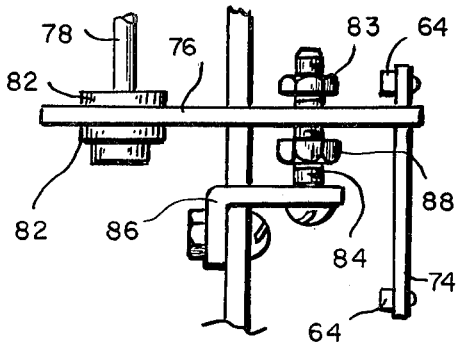
FIG. 3 is an elevation taken on the line 3—3 of FIG. 1.
Figure 5:
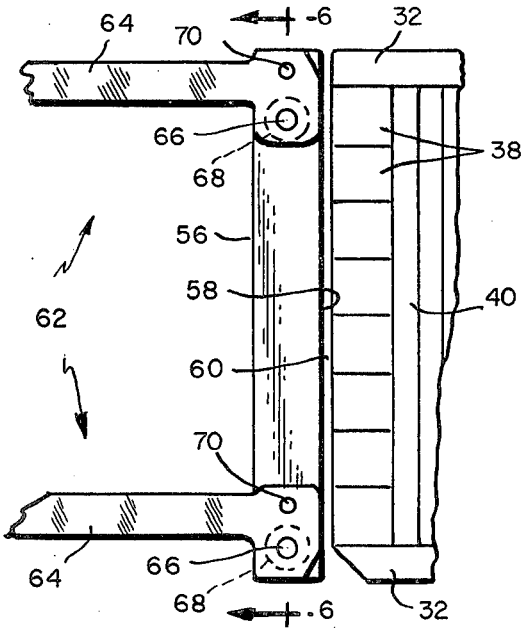
FIG. 5 is a fragmentary front view to larger scale showing the yarn passage at normal width.
Figure 6:
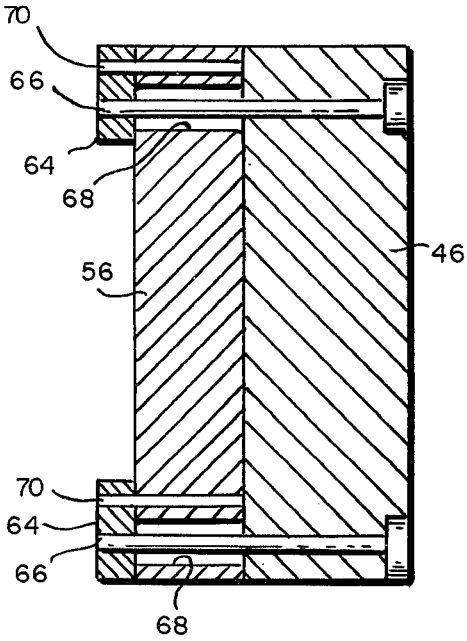
FIG. 6 is a section taken on the line 6—6 of FIG. 5.
Figure 7:
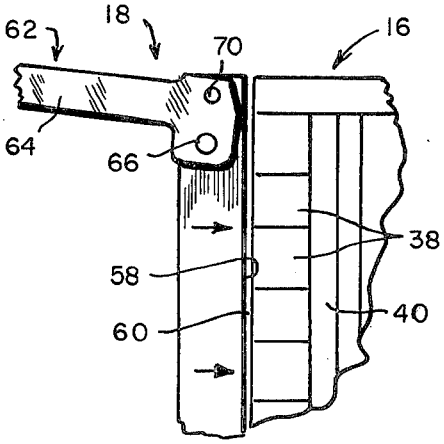
FIG. 7 is a fragmentary front view like FIG. 5 showing the yarn passage constricted.

In accordance with this invention the tensioning and the slub removing is effected by the movable assembly 18. As shown in FIGS. 2 and 4, the movable assembly comprises in part a rigid elongate block 46 supported at its lower end on the shelf 20 and yieldably held engaged with the blades 38 by the spring pressed plungers 28—28 previously referred to, the latter being mounted in pivotally supported arms 48—48. The arms 48—48 are fixed to a spindle 50 rotatably mounted in a bearing bracket 52 secured to the face of the apron and may be rotated as disclosed by prior patents embodying this same construction to enable sliding the block 46 forwardly relative to the blades 38 for clearing the device of lint and the like. The arms 48—48 are normally biased rearwardly with respect to the face of the apron as shown in FIG. 2 by spring means 54 so that the block is held against the apron. The block 46 is narrower from front to back than the blades 38 are long so that the blades project forwardly therefrom. A rigid bar 56 which has a flat uniformly smooth surface 58 substantially co-extensive in length with the collective surfaces of the narrow blades 38 from bottom to top is supported in a position of spaced relation to the forwardly projecting portions of the blade 38 and forms therewith a yarn passage 60 the back of which is constituted by the forward edge of the block 46. The bar 56 is supported for rectilinear movement relative to the narrow blades 38 so as to be movable toward and away from the blades 38 to adjust the width of the yarn passage. The support for the rigid bar 58 is provided for by a linkage 62 comprising a pair of spaced parallel links 64—64 pivotally mounted at one end on fixed pins 66—66, FIGS. 5 and 6, fixed in the block 46 so as to project horizontally forwardly therefrom. The bar 56 contains openings 68—68 of larger diameter than the pins 66—66 and is mounted over the forwardly projecting portions of these pins between the ends of the links 64—64 which are pivotally mounted on these pins and the face of the block 46. Additional pivot pins 70—70 pivotally connect the ends of the links with the bar 56 for pivotal movement about axes spaced from and parallel to the axes of the fixed pins 66—66. The opposite ends of the links 64—64 are pivotally connected by pins 72—72 to a connector link 74 corresponding substantially in length to the bar 56 and this in turn is connected by a rigidly fixed arm 76 to a rod 78 which comprises part of a yarn detector wire mechanisim of the kind shown in Abbott, U.S. Pat. No. 2,295,534. This mechanism as shown in FIG. 1A comprises a horizontal bar 13 rotatably mounted at its opposite ends on the apron 10 above the guide 12 on which there is mounted a U-shaped detector wire 10 over which the yarn runs and which is held upright by the running yarn. The bar 13 has fixed to it a rearwardly projecting extension 17 to which is connected the upper end of the rod 78. The mechanism operates identically with that shown in the aforesaid Abbott patent in that slack developing in the yarn allows the detector to fall outwardly thus moving the extension 17 upwardly and in turn moving the rod 78 upwrdly. The upward movement moves the member 56 toward the blades 38 to narrow the yarn passage and hence to apply a frictional retarding force to the yarn in order to take up the slack. The arm 76 has a rearwardly extending portion 88 at the rear extremity of which there is a hook 90 which makes a loop about the rod 78. Collars 82—82 fixed to the rod 78 by engagement with the hook will effect vertical movement thereof and this vertical movement is limited by the nuts 83—83 on a screw bolt 84 fixed to bracket 86. The yarn detector wire 78 by effecting movement of the connecting link 74 in an upward direction moves the bar 56 toward the bars 38 and by movement in a downwardly direction moves it away from the bars 38. By setting the position of the nuts the width of the passage may be limited to a predetermined opening. The arrangement is such that a decrease in tension in the running yarn will tend to close the yarn passage.

Figure 8:
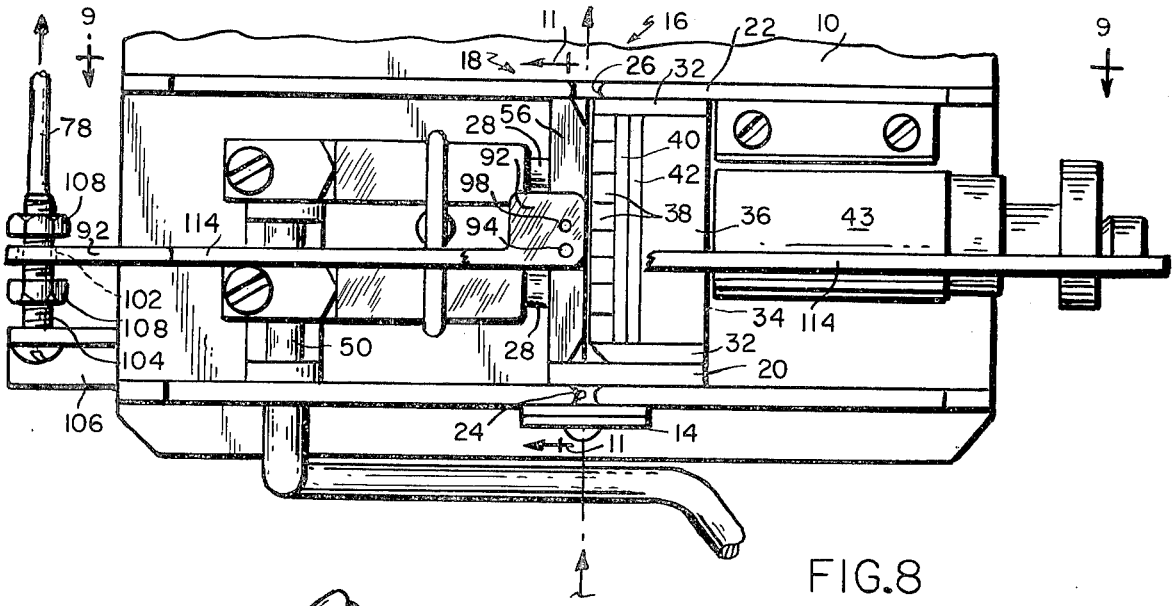
FIG. 8 is a front elevation of an alternative form of the invention.
Figure 9:
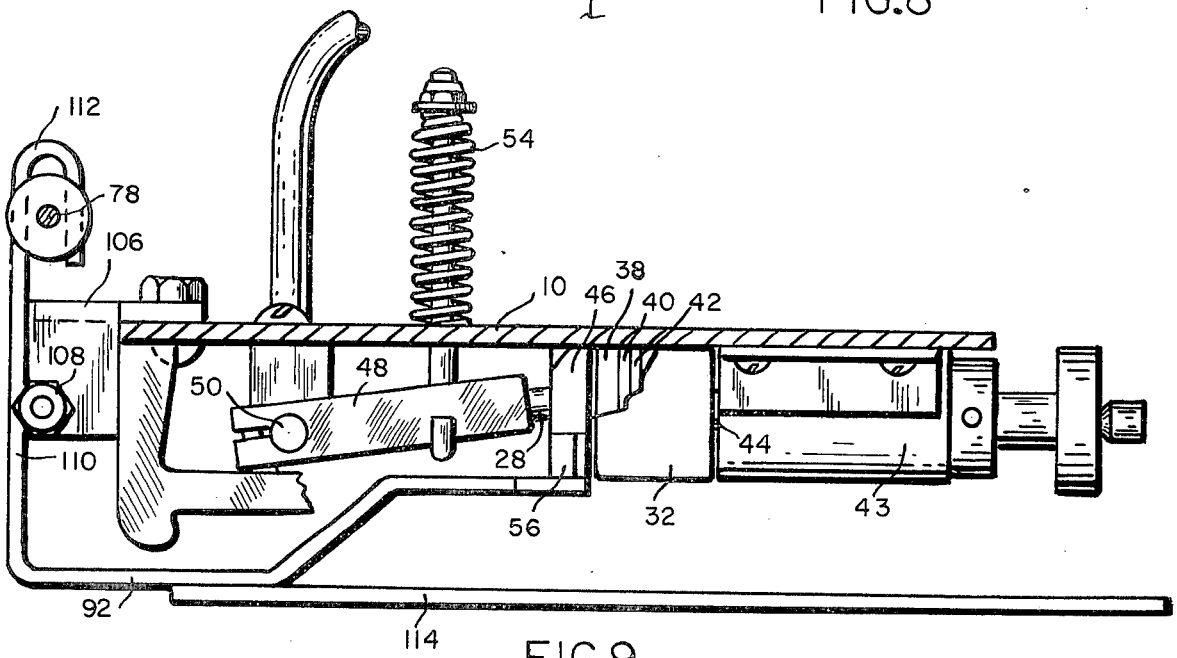
FIG. 9 is a top view taken on the line 9—9 of FIG. 8.
Figure 10:
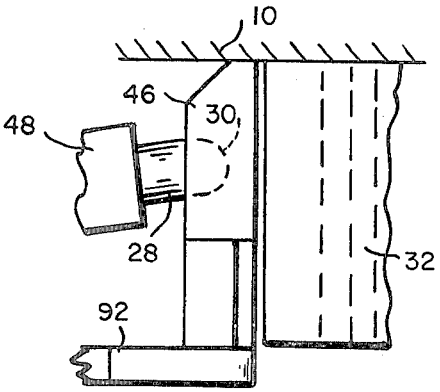
FIG. 10 is a top view at the left side of FIG. 9 to larger scale showing the yarn passage.
Figure 11:
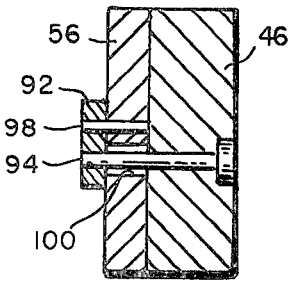
FIG. 11 is a section taken on the line 11—11 of FIG. 8.

FIGS. 8–11 inclusive show a modification of that shown in FIGS. 1–4 inclusive wherein the linkage comprises a single lever 92 pivotally mounted on a pin 94 fixed to the block 46, FIG. 11, and to the bar 56 by a pin 98. The bar 56 containing an opening 100 for receiving the pin 94. The lever 92 contains an opening 102 for receiving a threaded bolt 104 which is fixed to a bracket 106 and there are nuts 108—108 for limiting the movement of the lever 92. The lever 92 has a rearwardly extending arm 110, provided with a hook 112 which encircles the yarn detector wire 78. In this form of the invention to provide for greater stability the lever 92 has an extension 114 fastened to it which extends laterally across the yarn passage from left to right as shown in FIGS. 8 and 9. The extension may have mounted on it a weight to provide for counter balancing or adding to the effect of the rod 78.

In each form of the invention the entrances and exits from the yarn passage are beveled so as to facilitate entry of yarn into the passage without undue scuffing and without premature breakage.

I claim:

1. In a yarn processing machine, a support, spaced yarn guides on the support for guiding the yarn along a predetermined path and a combination tension and slub catching device mounted on the support between the guides, comprising members mounted on the support at opposite sides of the yarn path defining a narrow elongate yarn passage, one of said members having a rigid surface and the other a yieldable surface such as to yield with respect to the rigid surface when an enlargement in the yarn passes between them, means for fixing the position of the member having the yieldable surface relative to the member having the rigid surface, means movable in response to variations in yarn tension, and means for moving the member having the rigid surface perpendicularly with respect to the member having the yieldable surface in response to said last means to maintain a constant tension, comprising spaced parallel links, means pivotally connecting the links at one end to the support for pivotal movement about spaced parallel fixed axes parallel to the face of the member having the rigid surface, means connecting the same ends to said member having the rigid surface for pivotal movement about spaced parallel axes parallel to the member having the rigid surface, means pivotally connecting the other ends of said links to a rigid part for pivotal movement about spaced parallel axes parallel to the face of the member having the rigid surface at a spacing corresponding to the spacing between the fixed axes and means connecting said part to said tension responsive means.

2. In a yarn processing machine, a support, spaced yarn guides on the support for guiding the yarn along a predetermined path and a combination tension and slub catching device mounted on the support between the guides comprising members mounted on the support at opposite sides of the yarn path, said members projecting forwardly from the support, one of said members comprising a part fixed to the support having rigid bearing surfaces spaced apart in the direction of yarn travel between which there are yieldable bearing surfaces and the other a movable part having a rigid bearing surface which is continuous in the direction of yarn travel and which has surface engagement with the rigid bearing surfaces of the fixed part, said movable part being slidable forwardly relative to the rigid bearing surfaces of the fixed part, means yieldably holding the movable part in surface engagement with the rigid bearing surfaces of the fixed part, said movable part being narrower from front to back than the fixed part and said yieldable bearing surfaces comprising a plurality of narrow bars yieldably mounted on the fixed part between said rigid bearing surfaces so as to have yielding surface contact with the movable part and providing a yieldable surface at that side of the yarn passage, a rigid bar having a continuous flat surface substantially coextensive with the collective widths of the yieldable bars providing at the other side of the yarn passage a rigid surface, tension responsive means movable in response to variations in yarn tension and means supporting the rigid bar in engagement with the fixed part with its surface confronting the yieldable bars for moving perpendicularly thereto, comprising spaced parallel links, means pivotally connecting the links at one end of the movable part for pivotal movement about spaced fixed axes parallel to the face of the rigid bar, means connecting the same ends to said rigid bar for pivotal movement about spaced parallel axes parallel to the face of the rigid bar, means connecting the other ends of said links to a rigid part for pivotal movement about spaced parallel axes parallel to the face of the rigid bar at a spacing corresponding to the space between the fixed axes, and means connecting said rigid part to said tension responsive means, said rigid part being movable by said last-named means in response to changes in yarn tension to effect pivotal movement of said links about said fixed axes.

* * * * *